US006648264B1

(12) United States Patent
Kukizaki et al.

(10) Patent No.: US 6,648,264 B1
(45) Date of Patent: Nov. 18, 2003

(54) METHOD AND APPARATUS FOR COILING A METAL STRIP

(75) Inventors: Taichi Kukizaki, Chiba (JP); Toshio Imazeki, Chiba (JP); Kiyoshi Ueda, Chiba (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/831,520

(22) PCT Filed: Sep. 22, 1999

(86) PCT No.: PCT/JP99/05192

§ 371 (c)(1),
(2), (4) Date: May 10, 2001

(87) PCT Pub. No.: WO01/21335

PCT Pub. Date: Mar. 29, 2001

(30) Foreign Application Priority Data

Mar. 26, 1998 (JP) ..... 10-079924

(51) Int. Cl.[7] ..... B65H 23/06

(52) U.S. Cl. ..... 242/422.5; 242/534.2; 242/547

(58) Field of Search ..... 242/422.5, 422.9, 242/534.2, 547

(56) References Cited

FOREIGN PATENT DOCUMENTS

| | | |
|---|---|---|
| JP | A 56-126021 | 10/1981 |
| JP | A 59-92118 | 5/1984 |
| JP | A 5-154550 | 6/1993 |
| JP | A 8-141638 | 6/1996 |
| JP | A 11-277134 | 10/1999 |

*Primary Examiner*—John Q. Nguyen
(74) *Attorney, Agent, or Firm*—Oliff & Berridge, PLC

(57) ABSTRACT

It is adapted such that, when coiling a thin metal strip at high speed, no shape defect owing to a center buckle occurs in the metal strip, thereby intending an improvement in yield.

In a method of coiling a metal strip, adapted such that, before the coiling is finished, wrapper rolls 6 are pushed against an outer coiling face of a coil 5 to brake a rotation of the coil 5 and, by this, the rotation of the coil 5 is stopped in a short time at a coiling finish time, a pushing force of the wrapper roll 6 is made 10–20 kN/m.

7 Claims, 5 Drawing Sheets

METHOD AND APPARATUS FOR COILING A METAL STRIP

TECHNICAL FIELD

The present invention relates to a method of and an apparatus for coiling a metal strip when coiling on a mandrel the metal strip rolled at high speed like in a hot rolling and, in particular, relates to a method of and an apparatus for coiling a metal strip, each of which is adapted such that wrapper rolls are pushed against an outer coiling face of coil before a coiling is finished to thereby brake a rotation of the coil and, by this, the rotation of the coil is stopped in a short time when the coiling is finished.

BACKGROUND OF THE INVENTION

In a hot rolling line, a hot-rolled metal strip is coiled by a coiler disposed in a downstream side of a finishing mill, thereby making a coil. Hitherto, if one material to be rolled is finish-rolled, the rolled material to be rolled is coiled by the coiler as one coil. As to an unsteady portion such as tip portion or tail portion of the material to be rolled, a shape control or a meander control of the material to be rolled is difficult. Further, recently, it is desired to thin the hot-rolled metal strip, but if a thickness of the rolled metal strip becomes thin, the shape control or the meander control becomes more difficult. Therefore, by means of increasing a weight rolled in a finishing roll in one time by increasing a weight of one material to be rolled or connecting a preceding material to be rolled and a following material to be rolled in an inlet side of the finishing mill, it is performed to make a rate occupied by the unsteady portion small.

In this case, since there is a limit in the weight capable of being coiled by the coiler in one time, plural coilers are disposed, a strip shear is provided between the finishing mill and the coilers, the metal strip sent out from the hot finishing mill is cut in a predetermined length by the strip shear and, thereafter, it is coiled alternately by the plural coiling devices in a coil-like form. On this occasion, in order to shorten a time until the coiling of the metal strip by the next coiling device is started, it is necessary to stop the rotation of the coil in a short time as far as possible after the coiling of the metal strip by the present coiling device has finished.

As an apparatus for coiling a metal strip, which responds to such a demand, there is disclosed one described in Japanese Patent Laid-Open No.154550/1993 Gazette for instance. This apparatus for coiling a metal strip is one which is, as shown in FIG. 6, adapted such that plural wrapper rolls 6 are arranged so as to be able to approach or separate from an outer coiling face of a coil 5, the wrapper rolls 6 are approached toward the outer coiling face of the coil 5 to thereby apply a predetermined pushing force to the outer coiling face before finishing the coiling and, by this, a flutter of tail end of the coil 5 is prevented and the rotation of the coil 5 is stopped in a short time by being braked when finishing the coiling. Further, when starting the coiling, the wrapper rolls 6 are disposed adjacently to a mandrel 2 of a coiling device 1 to thereby sandwich a tip of the metal strip between them and the mandrel 2 and, by this, have in combination also a function of surely performing a coiling start operation. Incidentally, it is adapted such that, after the coiling has been started, the wrapper rolls 6 are disposed separating from the outer coiling face of the coil 5 until a predetermined time before the coiling is finished.

By the way, for example, in the aforesaid hot rolling method in which the preceding material to be rolled and the following material to be rolled are connected in the inlet side of the finishing mill, it is made possible to perform a thin material rolling by applying a stable tension over a whole length by means of continuously rolling one in which several to several tens rolling raw materials are connected.

However, in case that a thin metal strip is coiled at high speed by using the aforesaid conventional apparatus for coiling a metal strip, as shown in FIG. 7, when the outer coiling face of the coil 5 is pushed by the wrapper roll 6, if the wrapper roll 6 impinges against a portion located in a step between an inner coiling most tip portion (metal strip tip) 5*a* of the coil 5 in an outer coiling face of the coil 5 and a surface of the mandrel 2 (hereafter, referred to as step portion 16), the step portion 16 is rolled by a high pressure because the coil 5 is rotating at high speed. As a result, there is a disadvantage that a portion, of the metal strip being coiled, located at the step portion 16 generates a shape defect, so that a yield is deteriorated. And, it has been confirmed that this shape defect becomes remarkable in case that a thickness is 2.3 mm or less and a coiling speed is 700 mpm or higher. Incidentally, it is frequent that the wrapper roll 6 is provided with a convex crown, so that the aforesaid shape defect is mainly a center buckle.

Further, in ones described in Japanese Patent Laid-Open No. 126021/1981 Gazette and Japanese Patent Laid-Open No. 92118/1984 Gazette, there is disclosed a method of buffering an impact force generated in the step portion by, in a machine for coiling a metal strip, performing an operation for raising at a coil step portion generated in a metal strip tip portion before an upper roll passes in an initial stage of coiling the metal strip on a mandrel to thereby avoid an impingement and for lowering the upper roll after it has passed. However, since such a case as mentioned before in which the weight of one material to be rolled is large and the fact the one in which several to several tens rolling raw materials are connected is continuously rolled and coiled at high speed are not assumed, there is not disclosed the fact that, when finishing the coiling, it is stopped in a short time by means of braking a rotation of the coil by the plural wrapper rolls. Accordingly, in case that a continuous finish-rolling is performed or in case that a large unit weight coil is rolled, since a high speed winding is performed, there is a disadvantage that, in case that there is the step in a coil outer coiling portion, the step portion is rolled by a high pressure, so that this portion generates the shape defect.

The invention has been made in order to solve such a disadvantage, and its object is to provide a method of and an apparatus for coiling a metal strip, each of which can intend an improvement in yield by adapting such that the shape defect is not generated when coiling a thin metal strip at high speed.

DISCLOSURE OF THE INVENTION

In order to achieve such an object, the invention 1 is a method of coiling a metal strip, adapted such that, before the metal strip after a hot finish rolling is finished to be coiled on a mandrel, plural wrapper rolls are pushed against an outer coiling face of a coil to brake a rotation of the coil, thereby stopping the rotation of the coil, characterized in that a position of a step portion appearing in an outer coiling face of the coil owing to a step between an inner coiling most tip portion of the coil and a surface of the mandrel is detected, and a pushing force per a coil width 1m of the wrapper roll is made 20 kN/m or lower only during a predetermined time before and after the step portion passes a position of the wrapper roll.

A method of coiling a metal strip according to the invention 2 is characterized in that, in the invention 1, the wrapper roll is separated from the outer coiling face of the coil only during the predetermined time before and after the step portion passes the position of the wrapper roll.

A method of coiling a metal strip according to the invention 3 is characterized in that, in the invention 1, the pushing force per a coil width 1 m of the wrapper roll at the step portion and a portion other than the step portion is made 10–20 kN/m.

A method of coiling a metal strip according to the invention 4 is characterized in that, in the inventions 1–3, before the metal strip is finished to be coiled on the mandrel, the wrapper roll is approached from a waiting position nearer to the mandrel than an open limit toward the outer coiling face of the coil, thereby starting a pushing of the outer coiling face.

The invention 5 is an apparatus for coiling a metal strip, having a mandrel for coiling the metal strip in a coil-like form, plural wrapper rolls for pushing an outer coiling face of a coil coiled on the mandrel, a support frame which supports the wrapper roll and which is provided so as to be able to approach or separate from the outer coiling face of the coil, and drive means for causing the support frame to approach or separate from the outer coiling face of the coil, characterized by having strip shear controlling means for transmitting a coiling finish signal to a strip shear for cutting the metal strip after a hot finish rolling and to drive means for pushing the wrapper roll against the outer coiling face of the coil, step portion position detecting means for detecting a position of a step portion appearing in the outer coiling face of the coil owing to a step between an inner coiling most tip portion of the coil and a surface of the mandrel, and wrapper roll controlling means for controlling, on the basis of a detection position by the step portion position detecting means, the drive means such that a gap between the wrapper roll and the outer coiling face or a pushing force of the outer coiling face by the wrapper roll is changed.

An apparatus for coiling a metal strip according to the invention 6 is characterized in that, in the invention 5, the step portion position detecting means has means for detecting, when starting to coil the metal strip, a position of a tip of the metal strip coiled on the mandrel, means for operating the tip position as a rotation angle θ with respect to a predetermined position of the mandrel, means for storing the θ, and means for operating, before the metal strip is finished to be coiled, the θ as the position of the step portion appearing in the outer coiling face of the coil.

An apparatus for coiling a metal strip according to the invention 7 is characterized in that, in the invention 6, the θ is found by a sensor for detecting the fact that the metal strip tip has passed, a rotation speedometer for detecting a rotating speed of the coil, and a sheet speed detecting sensor.

A method of coiling a metal strip according to the invention 8 is characterized in that, in the invention 1, in case that a rotating speed of the coil is reduced to lower than a predetermined rotating speed, the pushing force of the wrapper roll is set so as to exceed 20 kN/m.

BEST MODE FOR CARRYING OUT THE INVENTION

Hereunder, embodiments of the invention are explained by referring FIG. 1–FIG. 5.

Figure 1:
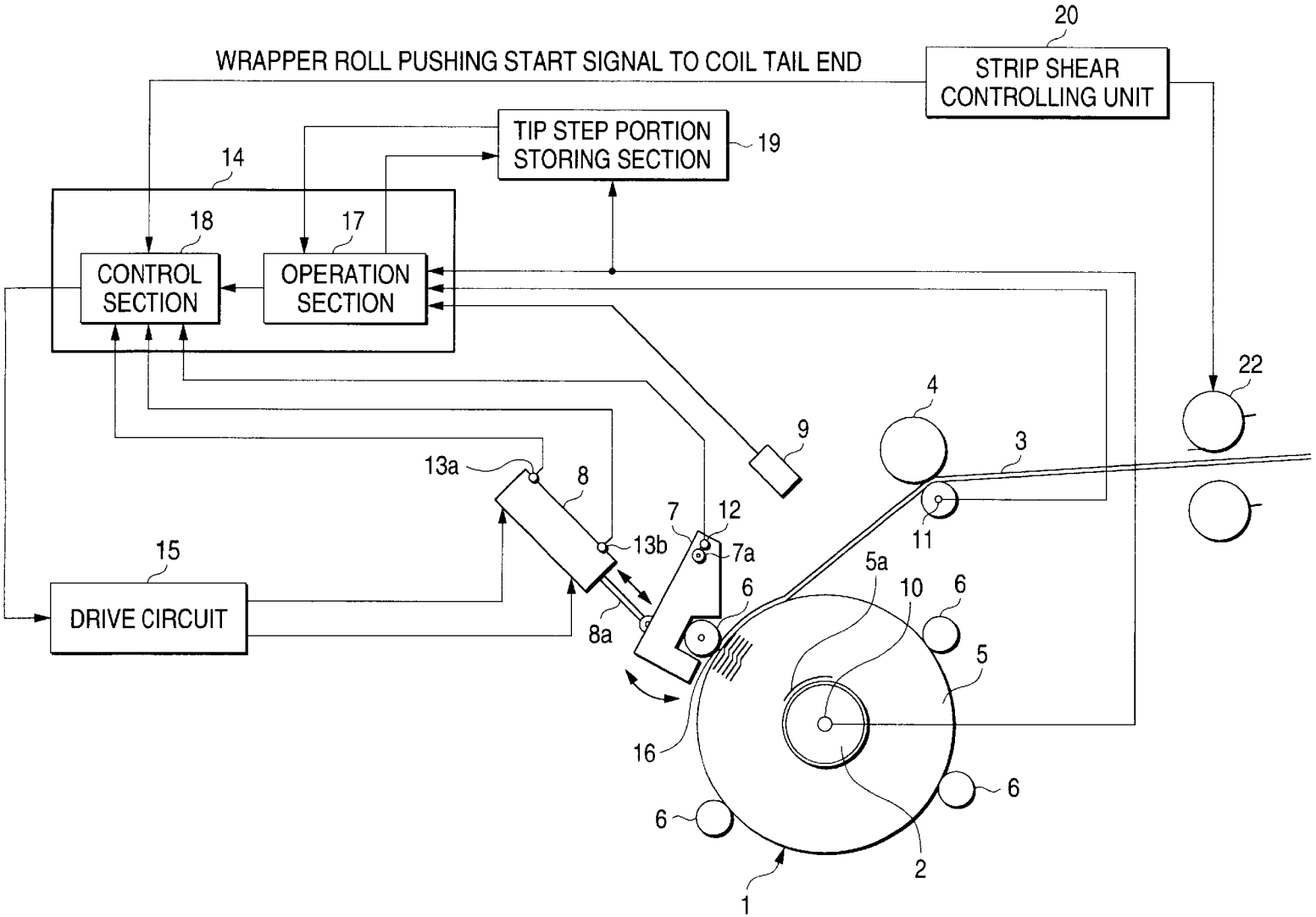
FIG. 1 is a schematic view for explaining an apparatus for coiling a metal strip, which is one example of $1^{st}$ embodiment of the invention.
Figure 2:
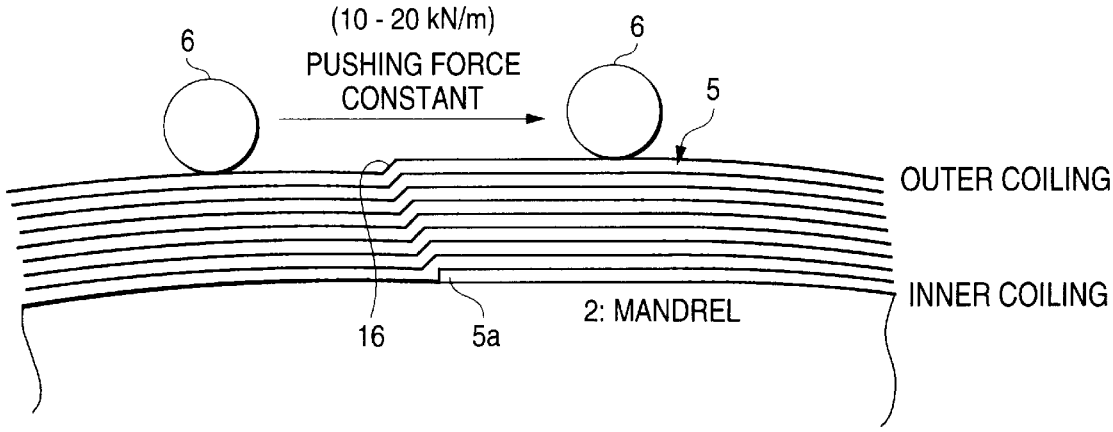
FIG. 2 is an explanatory view of the $1^{st}$ embodiment of the invention, which explains a relative operation of a wrapper roll with respect to a coil outer winding face in a coiling finish stage.
Figure 3:
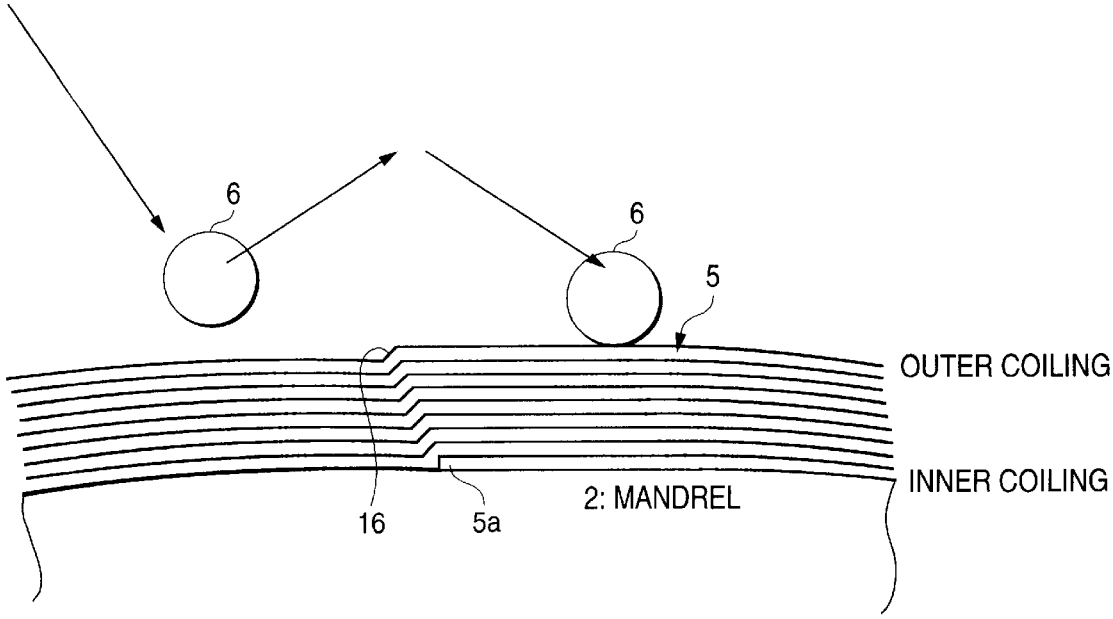
FIG. 3 is an explanatory view of the $1^{st}$ embodiment of the invention, for explaining the relative operation of t he wrapper roll with respect to the coil outer winding face in a pushing start time.
Figure 6:
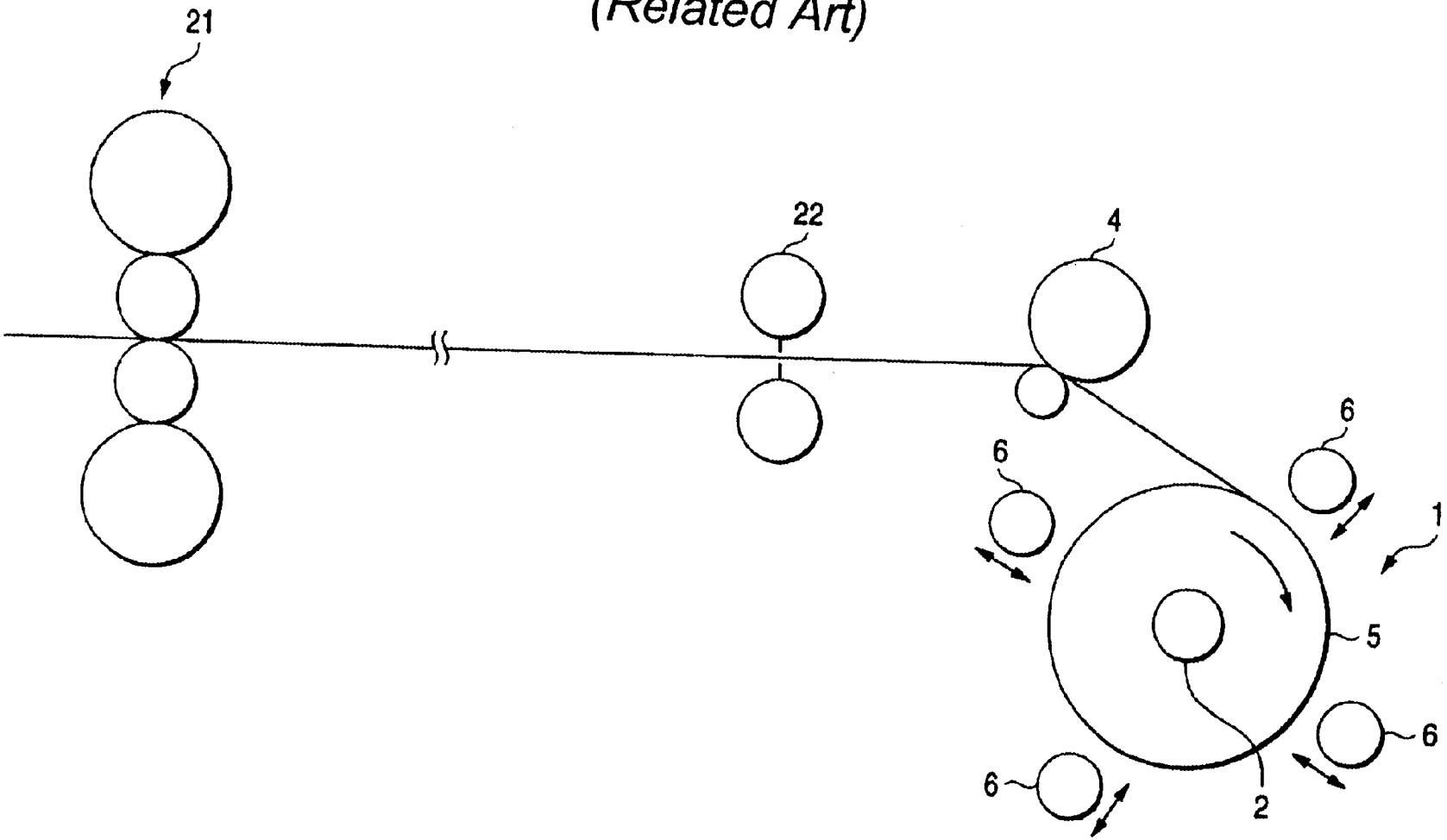
FIG. 6 (Related Art)
FIG. 6 is a schematic view for explaining a conventional apparatus for coiling a metal strip.
Figure 7:
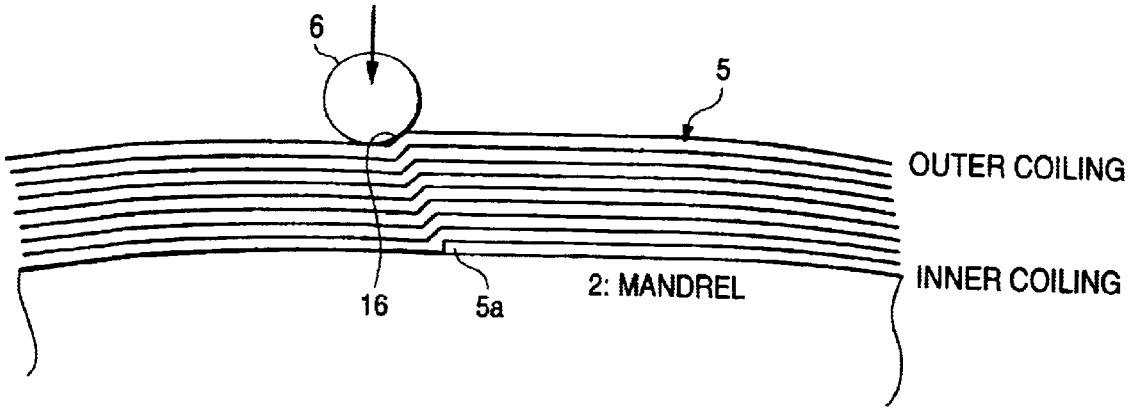
FIG. 7 (Related Art)
FIG. 7 is an explanatory view for explaining a step portion appearing in an outer coiling face of a coil owing to a step between an inner coiling most tip portion of the coil and a mandrel surface.

First, in explaining a 1st embodiment of the invention by referring to FIG. 1–FIG. 3, in FIG. 1, the reference numeral 2 denotes a mandrel for coiling, through a pinch roll 4, a metal strip 3 cut in a predetermined length by a strip shear (reference numeral 22 in FIG. 6) after passing through a hot finishing mill (reference numeral 21 in FIG. 6) in a coil-like form, and plural wrapper rolls (four places in FIG. 1) 6 are arranged in a peripheral direction with a predetermined spacing in an outer coiling face side of a coil 5 coiled on the mandrel 2.

Each wrapper roll 6 is respectively supported by a support frame (only one place is shown in FIG. 1) 7 provided so as to be rotatable through a rotation supporting point 7*a* in a direction approaching or separating from an outer coiling face of the coil 5, and a piston rod 8*a* of a hydraulic cylinder (drive means) 8 is connected to the support frame 7. It is adapted such that, by extending the piston rod 8*a*, the support frame 7 is rotated in the direction approaching the outer coiling face of the coil 5 and thus the wrapper roll 6 contacts with the outer coiling face and, by retracting it, the support frame 7 is rotated in the direction separating from the outer coiling face of the coil 5 and thus the wrapper roll 6 separates from the outer coiling face.

Further, between the coil 5 and the pinch roll 4, there is arranged a laser sensor 9 for detecting the fact that a tip of the metal strip 3 has passed, a detection sensor 10 for detecting a rotating speed and a rotation angle of the coil 5 is attached to the mandrel 2, a sheet speed detecting sensor 11 for detecting a carrying speed (sheet speed) of the metal strip 3 is attached to the pinch roll 4, a rotation angle detecting sensor 12 for detecting a rotation angle is attached to the support frame 7, and pressure detecting sensors 13*a*, 13*b* for detecting a working pressure are attached to the hydraulic cylinder 8. And, it is adapted such that, on the basis of a signal from each sensor, a controller 14 controls the hydraulic cylinder 8 through a drive circuit 15.

The controller 14 has an operation section 17 for operating, on the basis of the signals from the laser sensor 9, the rotating speed sensor 10 and the sheet speed detecting sensor 11, an inner coiling most tip portion 5*a* of the coil 5 as a rotation angle θ from a predetermined position of the mandrel, a tip step portion storing section 19 for storing the θ, the operation section 17 for operating, on the basis of a signal from a strip shear controlling section 20 before finishing the coiling of the metal strip, the θ as a position of a step portion 16 appearing in the outer coiling face of the coil 5 owing to a step between the coil and a surface of the mandrel 2, and a control section (control means) 18 for performing a position control and a pushing force control of the wrapper roll 6 with respect to the outer coiling face of the coil 5 by controlling the hydraulic cylinder 8 through the drive circuit 15. Here, in this embodiment, step portion position detecting means of the invention is constituted by the laser sensor 9, the rotating speed detecting sensor 10, the sheet speed detecting sensor 11, the operation section 17, the tip step portion storing section 19 and the strip shear controlling section 20, but it may be adapted such that the position of the step portion 16 is detected by another publicly known detecting means or tracking means and the like.

The control section 18 is adapted so as to control the hydraulic cylinder 8 in a coiling start stage and a coiling finish stage. In the coiling start stage, in order to surely perform a coiling start operation, the piston rod 8*a* of the hydraulic cylinder 8 is extended synchronizing with a coiling start timing of a tip of the metal strip 3, which is obtained on the basis of the signal from the laser sensor 9 and, by this, the support frame 7 is rotated by a predetermined angle in the direction approaching an outer face of the mandrel 2, thereby sandwiching the tip of the metal strip 3 between the wrapper roll 6 and the mandrel 2. Further, after a predetermined time has elapsed from the coiling start, the support frame 7 is rotated by a predetermined angle in the direction separating from the outer coiling face of the coil 5 by retracting the piston rod 8*a* and, by this, the wrapper roll 6 is caused to wait at a predetermined position by being shunted from the outer coiling face of the coil 5 until a predetermined time before the coiling is finished.

Incidentally, an extension/retraction amount of the piston rod 8*a* of the hydraulic cylinder 8 in this case is controlled such that a detection angle obtained by the rotation angle detecting sensor 12 agrees with a rotation angle (this is stored in a storage area of the control section 18) of the support frame 7, which is previously set in compliance with a sandwiching position of the metal strip 3 tip and a shunting position at the wrapper roll 6. Further, at the coiling start time, the aforesaid step portion 16 appears in the coil 5 outer coiling face between the wrapper roll 6 and the mandrel 2 correspondingly to the step between the most tip portion (metal strip tip) 5*a* of the metal strip 3 and the surface of the mandrel 2.

On the other hand, in the coiling finish stage, on the basis of a tail end wrapper roll pushing start signal from the strip shear controlling unit 20, first, when starting a pushing by the wrapper roll 6 against the coil 5 outer coiling face, it is judged whether or not the position θ, of the metal strip tip portion, operated by the operation section 17 on the basis of the signals from the laser sensor 9, the rotating speed detecting sensor 10 and the sheet speed detecting sensor 11 agrees with a contact position, stored in the storing section 19, of the wrapper roll 6 with respect to the coil 5 outer coiling face. In case that it does not agree with, the piston rod 8*a* of the hydraulic cylinder 8 is extended synchronizing with a previously set pushing start timing in order to brake the rotation of the coil 5 to stop it in a short time and, by this, the support frame 7 is rotated by a predetermined angle in the direction approaching the outer coiling face of the coil 5, thereby bringing the wrapper roll 6 into contact with the coil 5 outer coiling face.

In case that a position of the step portion 16 agrees with a contact start position of the wrapper roll 6, as shown in FIG. 3, the piston rod 8*a* of the hydraulic cylinder 8 is retracted before a predetermined time at which the step portion 16 reaches the contact start position of the wrapper roll 6 in order to avoid the contact and, by this, the support frame 7 is rotated by a predetermined angle in the direction separating from the outer coiling face of the coil 5 to thereby shunt the wrapper roll 6 from the coil 5 outer coiling and, after a predetermined time has elapsed from when the position of the step portion 16 has passed a contact position of the wrapper roll 6, the piston rod 8*a* of the hydraulic cylinder 8 is extended and, by this, the support frame 7 is rotated by a predetermined angle in the direction approaching the outer coiling face of the coil 5, thereby bringing the wrapper roll 6 into contact with the coil 5 outer coiling face.

Incidentally, an extension/retraction amount of the piston rod 8*a* of the hydraulic cylinder 8 in this case is controlled such that a detection angle obtained by the rotation angle detecting sensor 12 agrees with a rotation angle (this is stored in a storage area of the control section 18) of the support frame 7, which is previously set in compliance with a contact position and a shunting position with respect to the outer coiling face of the coil 5 at the wrapper roll 6.

After the wrapper roll 6 has contacted with the outer coiling face of the coil 5, the hydraulic cylinder 8 is controlled such that a detection pressure obtained from the pressure detecting sensors 13*a*, 13*b* agrees with a previously set working pressure for applying a predetermined pushing force to the outer coiling face of the coil 5. Here, a pushing force per a coil width 1 m of the wrapper roll 6 with respect to the outer coiling face of the coil 5 is made a range of 10–20 kN/m. If the pushing force is lower than 20 kN/m, a braking force necessary for a rotation of the coil is not obtained and, further, it is impossible to suppress a bulge of coil outer periphery portion owing to a centrifugal force at high speed rotation time. On the other hand, if it exceeds 20 kN/m, a high pressure is generated when the wrapper roll 6 impinges against the step portion 16 of the coil 5 rotating at high speed, so that a center buckle occurs in the coil 5.

Next, it is explained about an actuation of the control section 18.

First, in the coiling start stage, the piston rod 8*a* of the hydraulic cylinder 8 is extended synchronizing with the coiling start timing of the tip of the metal strip 3, which is obtained on the basis of the signal from the laser sensor 9, such that the detection angle obtained by the rotation angle detecting sensor 12 agrees with a rotation angle, of the support frame 7, previously set in compliance with a sandwiching position of the metal strip 3 tip at the wrapper roll 6, thereby rotating the support frame 7 in the direction approaching the outer face of the mandrel 2 and, by this, the tip of the metal strip 3 is sandwiched between the wrapper roll 6 and the mandrel 2, thereby surely performing a coiling start operation.

Further, after a predetermined time has elapsed from the coiling start, the piston rod 8*a* is retracted such that the detection angle obtained by the rotation angle detecting sensor 12 agrees with a rotation angle, of the support frame 7, previously set in compliance with a shunting position of the wrapper roll 6, thereby rotating the support frame 7 in the direction separating from the outer coiling face of the coil 5 and, by this, the wrapper roll 6 is shunted from the outer coiling face of the coil 5 until a predetermined time before the coiling is finished, thereby causing it to wait in a predetermined position. Incidentally, as to this waiting position, it is advantageous to locate it as nearly to the mandrel as possible than a open limit of the wrapper roll, because an operation for pushing the wrapper roll at a coiling finish time can be rapidly performed.

In the coiling finish stage, first, when starting the pushing by the wrapper roll 6 against the coil 5 outer coiling face, it is judged whether or not the position of the step portion 16 agrees with the contact position of the wrapper roll 6. In case that it does not agree with, the piston rod 8*a* of the hydraulic cylinder 8 is extended synchronizing with the previously set pushing start timing such that the detection angle obtained by the rotation angle detecting sensor 12 agrees with a rotation angle, of the support frame 7, previously set in compliance with the contact position with respect to the outer coiling face of the coil 5 at the wrapper roll 6 in order to brake the rotation of the coil 5 to stop it in a short time and, by this, the support frame 7 is rotated in the direction approaching the outer coiling face of the coil 5, thereby bringing the wrapper roll 6 into contact with the coil 5 outer coiling face.

In case that the position of the step portion 16 agrees with the contact position of the wrapper roll 6, as shown in FIG. 3, the piston rod 8*a* of the hydraulic cylinder 8 is retracted before the predetermined time at which the position of the step portion 16 reaches the contact position of the wrapper roll 6 such that the detection angle obtained by the rotation angle detecting sensor 12 agrees with a rotation angle, of the support frame 7, previously set in compliance with the shunting position with respect to the coil 5 outer coiling face of the wrapper roll 6 in order to avoid the contact and, by this, the support frame 7 is rotated in the direction separating from the outer coiling face of the coil 5 to thereby shunt the wrapper roll 6 from the coil 5 outer coiling and, after the predetermined time has elapsed from when the position of the step portion 16 has passed the contact position of the wrapper roll 6, the piston rod 8*a* of the hydraulic cylinder 8 is extended such that the detection angle obtained by the rotation angle detecting sensor 12 agrees with a rotation angle, of the support frame 7, previously set in compliance with the contact position with respect to the coil 5 outer coiling face of the wrapper roll 6 and, by this, the support frame 7 is rotated by in the direction approaching the outer coiling face of the coil 5, thereby bringing the wrapper roll 6 into contact with the coil 5 outer coiling face.

After the wrapper roll 6 has contacted with the outer coiling face of the coil 5, the hydraulic cylinder 8 is controlled such that the detection pressure obtained from the pressure detecting sensors 13*a*, 13*b* can obtain a previously set braking force necessary for the rotation of the coil 5 and agrees with a working pressure for giving a pushing pressure 10–20 kN/ m per a coil width 1 m, under which no shape defect occurs even if the wrapper coil 6 impinges against the step portion 16 of the coil 5 rotating at high speed, to the outer coiling face of the coil 5, the outer coiling face of the coil 5 is continued to be pushed by this pushing force until the coil 5 is speed-reduced to a predetermined rotating speed (speed at which no shape defect occurs in the step portion 16 even if the wrapper roll 6 pushed by the pushing force exceeding 20 kN/m impinges against the step portion 16 of the rotating coil 5: lower than 700 mpm), and, after it has been speed-reduced to the predetermined rotating speed, the pushing force is increased to exceed 20 kN/m, thereby increasing a rotation braking force of the coil 5.

As apparent from the above explanations, according to this embodiment, in the coiling finish stage, since it is adapted such that the braking force necessary for the rotation of the coil 5 is obtained and the outer coiling face of the coil 5 is pushed by the pushing force under which no shape defect occurs even if the wrapper coil 6 impinges against the step portion 16 of the coil 5 rotating at high speed, it is possible to adapt such that no shape defect occurs in the metal strip existing in a step portion 16 position after a thin (2.3 mm or less) metal strip is coiled at high speed (700 mpm or higher) as the coil and, as a result, it is possible to intend an improvement in yield.

Further, at a pushing start time of the coil 5 outer face by the wrapper roll 6, since it is adapted such that the wrapper roll 6 does not contact with the step portion 16, the impingement between the wrapper roll 6 and the step portion 16 of the coil 5 rotating at high speed is avoided at the pushing start time, so that an occurrence of the shape defect can be surely prevented.

Incidentally, in the aforesaid embodiment, as an example there is adopted a case in which the invention is applied when coiling the metal strip 3 cut in a predetermined length by the strip shear into a coil-like form, but it is needless to say that the invention may be applied to an ordinary batch rolling.

Further, as shown in FIG. 2, the wrapper roll may be always pushed by a constant pressure irrespective of whether or not the step portion 16 exists by means of controlling the hydraulic cylinder 8 so as to agree with a working pressure for giving the pushing force 10–20 kN/m to the outer coiling face of the coil 5. It is also possible that the outer coiling face of the coil 5 is continued to be pushed by this pushing force until the coil 5 is speed-reduced to the predetermined rotating speed as mentioned before and, after it is speed-reduced to the predetermined rotating speed (lower than 700 mpm), the pushing force is increased to enhance a rotation braking force of the coil 5.

Figure 4:
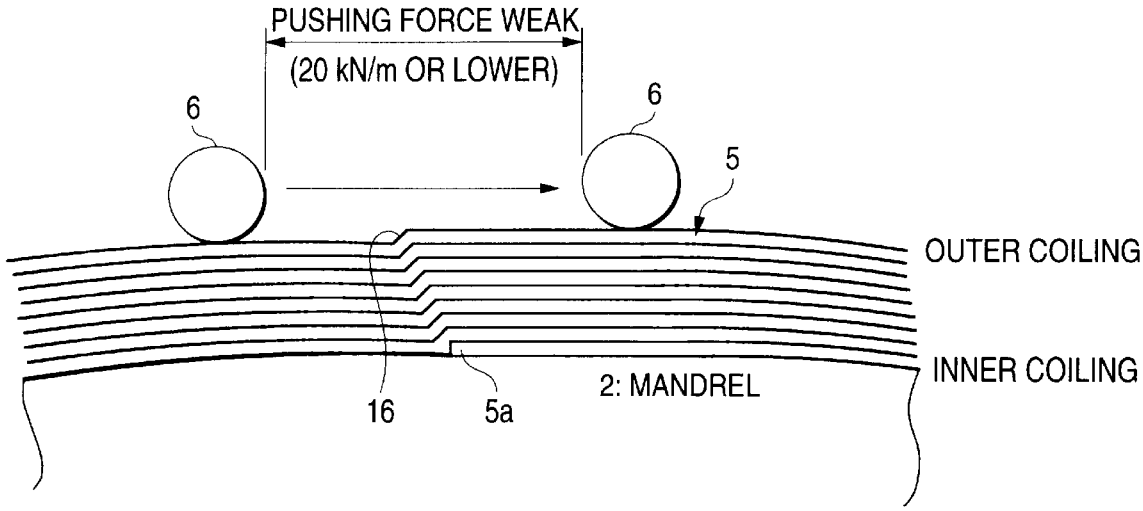
FIG. 4 is an explanatory view of the $2^{nd}$ embodiment of the invention, which explains the relative operation of the wrapper roll with respect to the coil outer winding face in the coiling finish stage.

Next, it is explained about a method of coiling a metal strip, which is an embodiment of a 2nd mode of the invention, by referring to FIG. 1 and FIG. 4. Incidentally, this coiling method differs with respect to the aforesaid coiling device 1 only in a controlling method of the hydraulic cylinder 8 by the control section 18 of the controller 14 after the wrapper roll 6 has contacted with the outer coiling face of the coil 5 in the coiling finish stage.

After the wrapper roll 6 has contacted with the outer coiling face of the coil 5 in the coiling finish stage, the control section 18 controls the hydraulic cylinder 8 such that the detection pressure obtained from the pressure detecting sensors 13*a*, 13*b* agrees with a previously set working pressure for giving a pushing force forcedly braking the rotation of the coil 5 to the outer coiling face of the coil 5 until a predetermined time before the position, of the step portion 16, operated by the operation section 17 on the basis of the signals from the laser sensor 9, the rotating speed detecting sensor 10 and the sheet speed detecting sensor 11 reaches a contact position, of the wrapper roll 6 with respect to the coil 5 outer coiling face, previously stored in the storage area (not shown). It is preferable that the pushing force on this occasion is a large value (exceeding 20 kN/m) in order that a braking force for the rotation of the coil 5 by the wrapper roll 6 is obtained.

Further, during a time from a predetermined time at which the step portion 16 reaches the contact position of the wrapper roll 6 to a time point at which a predetermined time has elapsed after the step portion 16 has passed the contact position of the wrapper roll 6, the hydraulic cylinder 8 is controlled such that the detection pressure obtained from the pressure detecting sensors 13*a*, 13*b* gives a weak pushing force (20 kN/m or lower) previously set such that no shape defect occurs in the step portion 16 even if the wrapper roll 6 impinges against the step portion 16 of the coil 5 rotating at high speed.

Incidentally, the control for weakening the pushing force by the wrapper roll 6 is performed until the coil 5 is speed-reduced to a predetermined rotating speed (speed at which no shape defect occurs in the step portion 16 even if the wrapper roll 6 pushing by a strong pushing force (exceeding 20 kN/m) impinges against the step portion 16 of the rotating coil 5: lower than 700 mpm) and, after being speed-reduced to the predetermined rotating speed, the pushing force is increased to enhance the rotation braking force of the coil 5.

As apparent from the above explanations, in this embodiment since it is adapted such that, in the coiling finish stage, a sufficient braking force is obtained for the rotation of the coil 5 and, before and after the step portion 16 passes the contact position of the wrapper roll 6, the outer face of the coil 5 is pushed by such a weak pushing force that no shape defect occurs in the step portion 16 even if the wrapper roll 6 impinges against the step portion 16 of the coil 5 rotating at high speed, it is possible, after coiling the coil 5 of the thin (2.3 mm or less) metal strip at high speed (700 mpm or higher), to prevent the shape defect from occurring in the metal strip and, as a result, the improvement in yield can be intended. Incidentally, since another action/effect is the same as the embodiment of the 1st mode mentioned above, its explanation is omitted.

Figure 5:
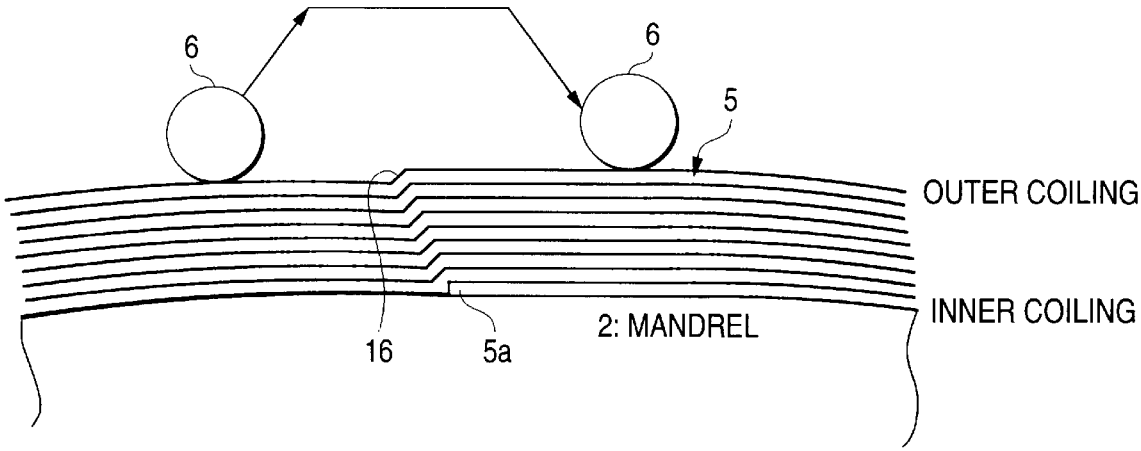
FIG. 5 is an explanatory view of a $3^{rd}$ embodiment of the invention, which explains the relative operation of the wrapper roll with respect to the coil outer winding face in the coiling finish stage.

Next, it is explained about a method of coiling a metal strip, which is an embodiment of a 3rd mode of the invention, by referring to FIG. 1 and FIG. 5. Incidentally, also this coiling method differs with respect to the aforesaid coiling device 1 only in a controlling method of the hydraulic cylinder 8 by the control section of the controller 14 after the wrapper roll 6 has contacted with the outer coiling face of the coil 5 in the coiling finish stage.

After the wrapper roll 6 has contacted with the outer coiling face of the coil 5 in the coiling finish stage, the control section 18 controls the hydraulic cylinder 8 such that the detection pressure obtained from the pressure detecting sensors 13*a*, 13*b* agrees with the previously set working pressure for giving the pushing force forcedly braking the rotation of the coil 5 to the outer coiling face of the coil 5 until the predetermined time before the position, of the step portion 16, operated by the operation section 17 on the basis of the signals from the laser sensor 9, the rotating speed detecting sensor 10 and the sheet speed detecting sensor 11 reaches the contact position, of the wrapper roll 6 with respect to the coil 5 outer coiling face, previously stored in the storage area (not shown).

Further, during the time from the predetermined time at which the step portion 16 reaches the contact position of the wrapper roll 6 to the time point at which the predetermined time has elapsed after the step portion 16 has passed the contact position of the wrapper roll 6, the piston rod 8*a* of the hydraulic cylinder 8 is retracted such that the detection angle obtained by the rotation angle detecting sensor 12 agrees with the rotation angle, of the support frame 7, previously set in compliance with the shunting position of the wrapper roll 6 with respect to the coil 5 outer coiling face and, by this, the support frame 7 is rotated in the direction separating from the outer coiling face of the coil 5, thereby controlling the wrapper coil 6 so as to be shunted from the coil 5 outer coiling face.

Further, after a predetermined time has elapsed from a time point at which the position of the step portion 16 has passed the aforesaid contact position, the piston rod 8*a* of the hydraulic cylinder 8 is extended such that the detection angle obtained by the rotation angle detecting sensor 12 agrees with the rotation angle, of the support frame 7, previously set in compliance with the contact position of the wrapper roll 6 with respect to the coil 5 outer coiling face and, by this, the support frame 7 is rotated in the direction approaching the outer coiling face of the coil 5, thereby bringing the wrapper roll 6 into contact with the coil 5 outer coiling face and, thereafter, the hydraulic cylinder 8 is rapidly controlled such that the detection pressure obtained from the pressure detecting sensors 13*a*, 13*b* agrees with a previously set working pressure for giving a pushing force forcedly braking the rotation of the coil 5 to the outer coiling face of the coil 5.

Incidentally, the control for shunting the wrapper roll 6 from the step portion 16 is performed until the coil 5 is speed-reduced to a predetermined rotating speed (speed at which no center buckle occurs in the coil 5 even if the wrapper roll 6 impinges against the step portion 16 of the rotating coil 5) and, after it has been speed-reduced to the predetermined rotating speed (lower than 700 mpm), the pushing force is increased to enhance the rotation braking force of the coil 5.

As apparent from the above explanations, in this embodiment since it is adapted such that, in the coiling finish stage, a sufficient braking force is obtained for the rotation of the coil 5 and, before and after the step portion 16 passes the contact position of the wrapper roll 6, the wrapper roll 6 does not impinge against the step portion 16 of the coil 5 rotating at high speed, it is possible, after coiling the thin (2.3 mm or less) metal strip into the coil 5 at high speed (700 mpm or higher), to prevent the shape defect from occurring in the metal strip and, as a result, the improvement in yield can be intended. Incidentally, since another action/effect is the same as the embodiment of the 1st mode mentioned above, its explanation is omitted.

Industrial Applicability

As apparent from the above explanations, according to the invention, since it is possible to adapt such that, after coiling the thin metal strip into the coil at high speed, no shape defect occurs in the coiled metal strip, there is obtained an effect that the improvement in yield can be intended.

Further, when starting to push the coil outer coiling face by the wrapper roll, since the impingement between the wrapper roll and the step portion of the coil rotating at high speed can be avoided at the pushing start time by controlling the wrapper roll so as not to contact with the step portion, there is obtained an effect that an occurrence of the shape defect can be surely prevented.

What is claimed is:

1. A method of coiling a metal strip, adapted such that, before the metal strip after a hot finish rolling is finished to be coiled on a mandrel, plural wrapper rolls are pushed against an outer coiling face of a coil to brake a rotation of the coil, thereby stopping the rotation of the coil, characterized in that a position of a step portion appearing in an outer coiling face of the coil owing to a step between a most tip portion of an inner coiling face of the coil and a surface of the mandrel is detected, and a pushing force of the wrapper roll is made 20 kN/m or lower only during a predetermined time before and after the step portion passes a position of the wrapper roll, the metal strip being coiled having a thickness of about 2.3 mm or less, and coiling on the mandrel being performed at a coiling speed of greater than about 700 m per minute.

2. A method of coiling a metal strip of claim 1, characterized in that each of the wrapper rolls is separated from the outer coiling face of the coil only during the predetermined time before and after the step portion passes the position of the respective each wrapper roll.

3. A method of coiling a metal strip of claim 2, characterized in that, before the metal strip is finished to be coiled on the mandrel, the wrapper roll is approached from a waiting position toward the outer coiling face of the coil, thereby starting a pushing of the outer coiling face.

4. A method of coiling a metal strip of claim 1, characterized in that, before the metal strip is finished to be coiled on the mandrel, at least one wrapper roll is approached from a waiting position toward the outer coiling face of the coil, thereby starting a pushing of the outer coiling face.

5. A method of coiling a metal strip of claim 1, characterized in that the pushing force of the wrapper roll at the step portion and a portion other than the step portion is made 10–20 kN/m.

6. A method of coiling a metal strip of claim 5, characterized in that, before the metal strip is finished to be coiled on the mandrel, the wrapper roll is approached from a waiting position toward the outer coiling face of the coil, thereby starting a pushing of the outer coiling face.

7. A method of coiling a metal strip of claim 1, characterized that, in case that a rotating speed of the coil is reduced to lower than a predetermined rotating speed, the pushing force the wrapper roll is set so as to exceed 20 kN/m.

* * * * *